United States Patent [19]

Henderson

[11] Patent Number: 4,746,278

[45] Date of Patent: May 24, 1988

[54] DISPLACEMENT PUMP DESIGNED FOR CLEANING

[76] Inventor: James K. Henderson, 11 Parkend Ave., Brampton, Ontario, Canada, L6Y 1B4

[21] Appl. No.: 89,420

[22] Filed: Aug. 26, 1987

[51] Int. Cl.[4] ..... F04B 21/02

[52] U.S. Cl. ..... 417/454; 417/568

[58] Field of Search ..... 417/454, 430, 568, 567; 418/46; 15/104.16; 137/244

[56] References Cited

U.S. PATENT DOCUMENTS

| | | | |
|---|---|---|---|
| 1,850,083 | 3/1932 | Noltein | 417/568 |
| 1,867,585 | 7/1932 | Moore | 417/568 |
| 2,609,756 | 9/1952 | Wright et al. | 417/454 |
| 2,733,664 | 2/1956 | Saalfrank | 417/454 |
| 3,802,807 | 4/1974 | Kilayko | 417/430 |
| 4,097,202 | 6/1978 | Price | 417/454 |

*Primary Examiner*—Leonard E. Smith
*Assistant Examiner*—Leonard P. Walnoha

[57] ABSTRACT

A displacement pump has a pump chamber connected with an inlet valve chamber and an outlet valve chamber. The chambers are arranged so that a cleaning tool has a direct cleaning path through the inlet valve chamber, its connection to the pump chamber, the connection of the outlet valve to the pump chamber and the outlet valve.

3 Claims, 3 Drawing Sheets

DISPLACEMENT PUMP DESIGNED FOR CLEANING

This invention relates to a displacement pump which is useful for pumping any substance with a liquid vehicle like water to thin solutions to thick slurries. However the invention advantages are more significant for pumps used with thick slurries.

Displacement pumps, particularly those designed for thick slurries require cleaning to prevent the clogging of passages and the blockage of moving parts. Such clogging and blockage are more frequently required if the staff using the pump does not flush the pump after each use. However, even with proper cleaning procedures, such clogging and blockage will take place.

It is an objective of the invention to provide a displacement pump having a displacement chamber and inlet and outlet valve chambers, where a conduit joins the inlet valve chamber to the displacement chamber and a conduit joins the outlet valve chamber to the displacement chamber. In accord with the invention, the conduits are aligned and one of the valve chambers is provided with a port, closed by a removable plug, located on the wall of one of the valve chambers remote from the displacement chamber and aligned with said conduits. Removal of the plug therefore allows a drill or other cleaning inplement to be inserted through the aligned conduits for cleaning both in a single stroke of the drill or cleaning tool. Means are provided for moving valve or displacement parts clear of such tool travel. The conduits and chambers are thus conveniently cleaned.

It is an object of a preferred facet of the invention to provide, in addition to the arrangement of the previous paragraph, access to the valve chamber and the displacement chamber in a direction perpendicular to the tool path. Thus these chambers may be cleaned at the same time as the passage, and the entire pump is rendered easy to clean.

In drawings which illustrate a preferred embodiment of the invention:

Figure 1:
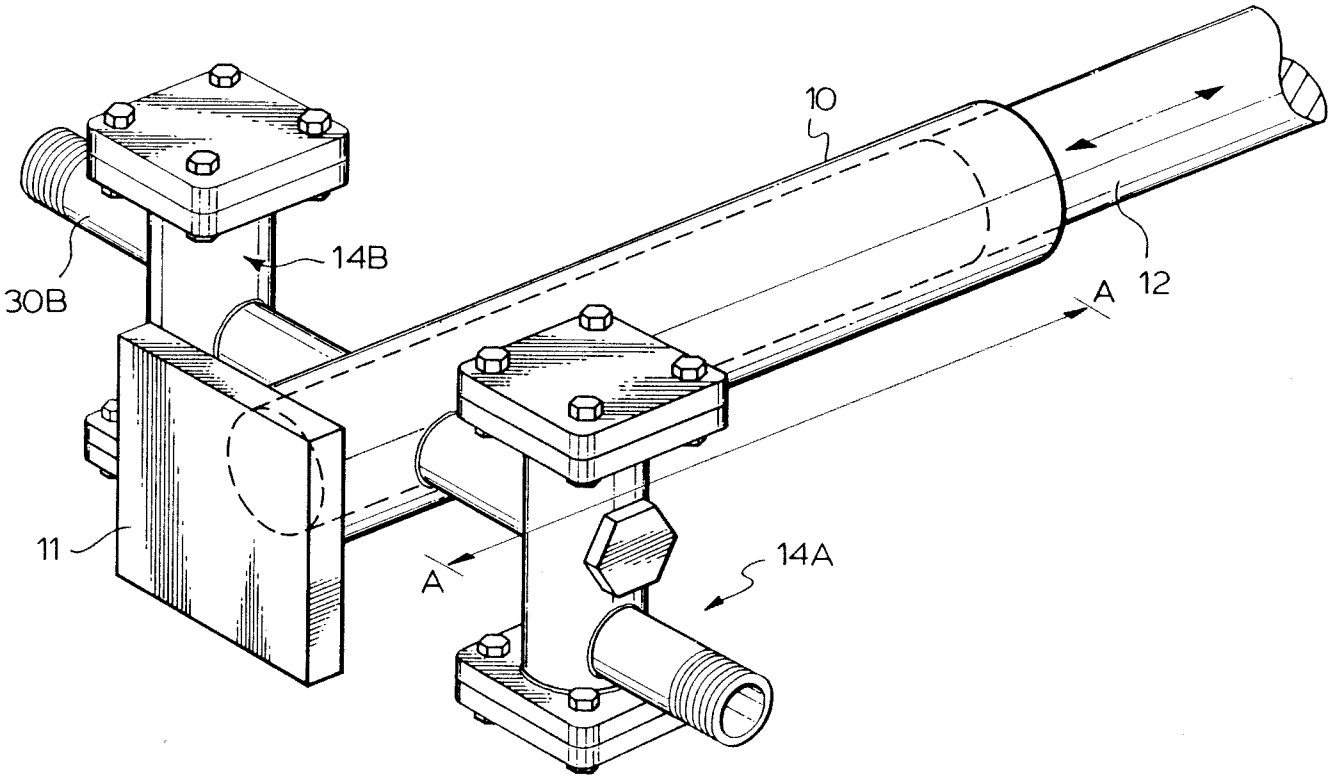
FIG. 1 shows a perspective view of a horizontal displacement pump chamber and inlet and outlet valves.
Figure 2:
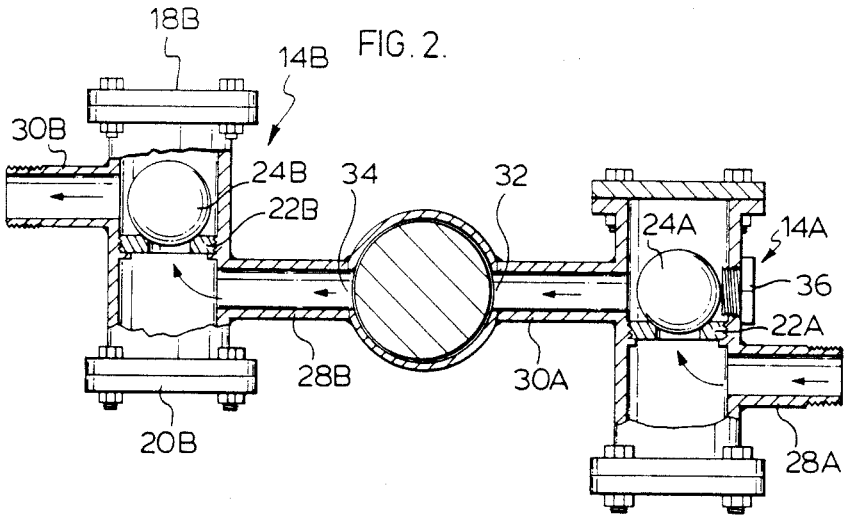
FIG. 2 is a vertical section of the device of FIG. 1, taken through the valve chambers.
Figure 3:
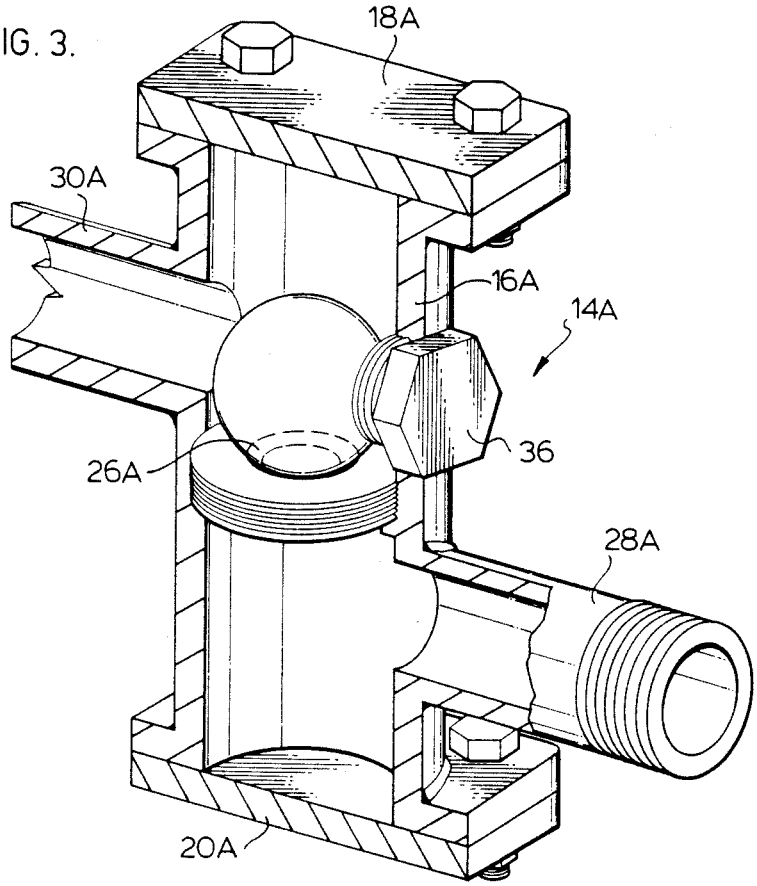
FIG. 3 is a broken away perspective of the inlet valve chamber.

In the drawings, FIG. 1 shows the cylindrical wall 10 defining with end wall 11, the displacement chamber of a pump with a horizontal longitudinal axis for the chamber. Reciprocable therein is a plunger 12, having a stroke A-A. Details for the packing of the plunger, the sealing of the displacement chamber and the plunger drive are not shown as they may be conventional and form no part of the invention. It should be noted that the invention is equally applicable to pumps where the longitudinal axis of the chamber of the pump is vertical.

An inlet gravity ball valye 14A comprises a vertical tube 16A defining a valve chamber closed by upper and lower removable caps 18A and 20A. A valve seat 22A (this is a schematic representation only) is screwed in place in tube 16A and ball 24A is ground to seal on the surface 26A of the seat. The valve is provided with an inlet conduit 28A and an outlet conduit 30A. An outlet gravity ball valve 14B is identical in construction (although not in connection) to valve 14A and the parts of valve 14B are identically numbered to those of 14A with the suffix 'B' substituted for 'A'. The input valve has its output conduit 30A connected to inlet port 32 of the displacement chamber 35 and its input conduit threaded to connect to a liquid or slurry supply line, not shown. The output valve has its inlet conduit 28B connected to the output port 34 of the displacement chamber and its output conduit 30 threaded to a liquid or slurry delivery line, not shown.

It will be noted that conduit 30A and conduit 28B are aligned and hence connect on opposite sides of the displacement chamber. One of the valves, here valve A has a threaded plug 36 on the side of tube 16A remote from displacement chamber and aligned with conduit 30A.

Figure 4:
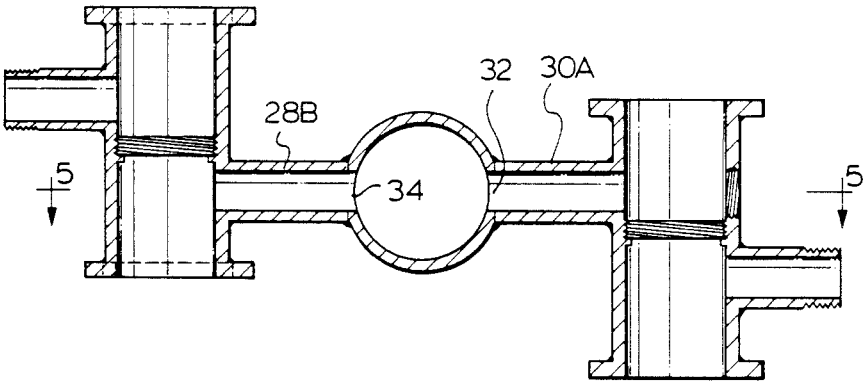
FIG. 4 is a section similar to FIG. 2 with the operating valve members removed and the plunger retracted.
Figure 5:
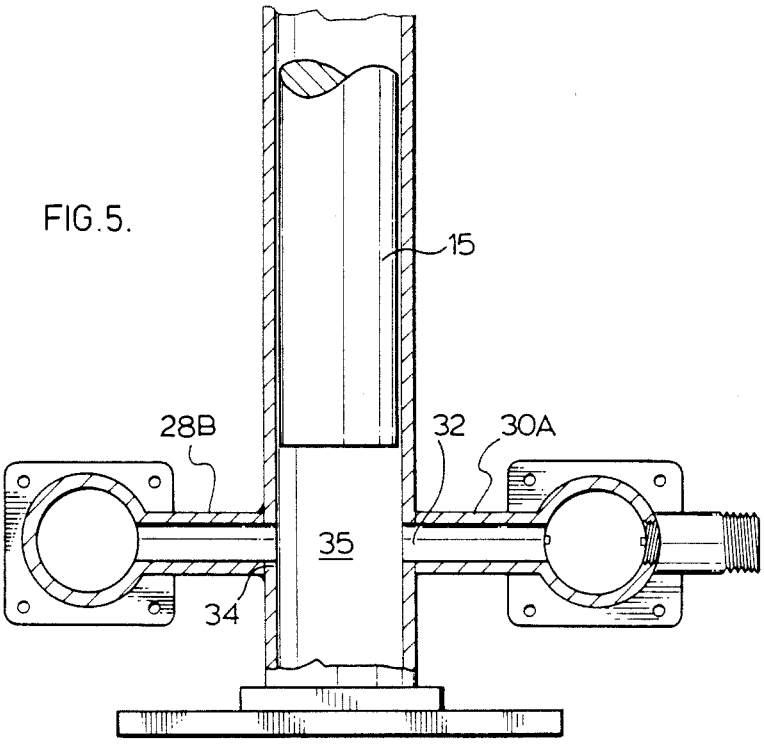
FIG. 5 is a horizontal section corresponding to FIG. 4.

To clean the pump in accord with the invention the plunger 15 of the displacement pump is moved clear of the aligned conduits 30A and 28B as best shown in FIG. 4. The valve seats 22A and 22B may also be removed as shown although this is not always necessary. Plug 36 is then removed. The conduits 28B and 30A may then be cleared in a single stroke by a tool (such as pneumatic drill) inserted through the plug hole and the two conduits. The valves may also be cleaned from top to bottom. Although not shown, the displacement chamber is usually designed to be opened and cleaned from each end. There is thus designed a pump easy to clean.

It will be noted that the axes of gravity ball valves 14A and 14B and of the displacement chamber are each perpendicular to that of the aligned conduits. It will be noted that the invention could equally be applied to a displacement pump where the displacement chamber was vertical or sloping rather than horizontal although such displacement chamber would still be perpendicular to the aligned conduits.

I claim:

1. In a displacement pump including a displacement chamber, a plunger reciprocable therein, inlet and outlet ports to and from said chamber, a one-way gravity ball inlet valve and valve chamber and a one-way gravity ball outlet valve and valve chamber connecting to said inlet and outlet ports respectively, the improvement comprising:

a generally horizontal conduit connecting said inlet port and said inlet valve chamber, a generally horizontal conduit connecting said outlet port to said outlet valve chamber, said conduits and their connecting ports being located opposite each other, said conduits being aligned, a removable plug located in one of said valve chambers on the side thereof remote from said displacement chamber, said plug being located in alignment with said aligned conduits, whereby when said plug is removed an aligned cleaning passage may be provided extending through the port defined by said port, across one valve chamber, through the corresponding aligned conduit, across the displacement chamber through the other aligned conduit, and across the other valve chamber, said inlet valve and valve chamber, outlet valve and valve chamber and plunger and displacement chamber being designed so that the components thereof may be moved clear of said passage when said cleaning passage is used.

2. In a displacement pump as claimed in claim 1 wherein both ends of said valves may be opened for cleaning.

3. In a displacement pump having a displacement pump with a displacement chamber having inlet and outlet gravity ball valves and valve chambers, connected to the displacement chamber by generally horizontal inlet and outlet conduits, wherein the inlet and outlet conduits are aligned and arranged on opposite sides of the displacement chamber, and a plug is removably located in one of said valve chambers opposite and aligned with the corresponding aligned conduit, whereby a cleaning tool may be inserted through the opening to clean both conduits and the aligned portions of the valve chambers and the displacement chambers.

* * * * *